United States Patent [19]

Rule et al.

[11] 4,084,570

[45] Apr. 18, 1978

[54] FIREPLACE CLOSURE AND SAFETY DEVICE

[75] Inventors: Adrian O. Rule; William E. Bartley, both of Chagrin Falls, Ohio

[73] Assignee: Integrated Development & Manufacturing Co., Chagrin Falls, Ohio

[21] Appl. No.: 721,969

[22] Filed: Sep. 10, 1976

[51] Int. Cl.[2] ..... F24C 15/02

[52] U.S. Cl. ..... 126/140; 126/202; 160/35

[58] Field of Search ..... 160/84, 35, DIG. 9; 126/138, 139, 140, 202

[56] References Cited

U.S. PATENT DOCUMENTS

| | | | |
|---|---|---|---|
| 2,077,324 | 4/1937 | Horner | 126/138 |
| 2,423,987 | 7/1947 | Levikow | 160/35 |
| 3,020,951 | 2/1962 | Graulich | 160/35 |
| 3,423,121 | 1/1969 | Lipkin | 160/35 |
| 3,457,907 | 7/1969 | Brunig | 126/140 |
| 3,921,619 | 11/1975 | Barriball | 160/35 |

*Primary Examiner*—John J. Camby
*Assistant Examiner*—Larry I. Schwartz
*Attorney, Agent, or Firm*—Oldham, Oldham, Hudak & Weber & Co.

[57] ABSTRACT

A fireplace closure device having both safety and decorative features is provided for mounting on the front of various sized masonry fireplaces. Fundamentally, the device comprises a plurality of laterally hinged slats with tapered pins being provided to hold the slats against the frame when closed such that the fireplace opening is sealed. A storage box, integral with the closure device frame, is included to store the hinged slats in such a manner as to permit use of the fireplace when the device is stored without obstructing the view from the adjacent living space or interfering with the addition of combustible materials to the fire or the use of common fireplace tools.

5 Claims, 8 Drawing Figures

FIREPLACE CLOSURE AND SAFETY DEVICE

BACKGROUND OF THE INVENTION

The invention is in the field of fireplace screens and accessories and more particularly to closure devices, screens, and combinations thereof which permit an unobstructed view of the fire while preventing sparks from the same from entering the room when the fireplace is in use and which can sealingly close the fireplace opening when not in use. In the prior art, flexible wire mesh screens and rigid mesh screens have been used to prevent sparks from entering a room from the fireplace. In such known structures, partially burned combustible materials can fall against the screen and burning elements may even pass through the screen and create a dangerous condition. This is particularly true when the fireplace is unattended. Further, such known screens permit cold drafts to enter the room after the fire has died out, spreading ashes and soot within the room. Dampers can be closed only after waiting a period of time to allow the fire to go out and, in the closed position, present a danger that the next fire may be started prior to opening the damper. Glass closures overcome some of these drawbacks of mesh screens but also block the infrared wavelengths preventing much of the heat from the fire from entering the room. In the prior art patent to Barriball, U.S. Pat. No. 3,921,619, a device is disclosed which seals the opening when the fireplace is not in use but which contains no screen to prevent sparks from entering the room when the fireplace is in use. A further shortcoming in the Barriball teaching is the lack of any storage container for the slats so that damage to the hinged slats from heavy logs and other combustible materials falling thereon or rolling thereacross is circumvented.

SUMMARY OF THE INVENTION

It is, therefore, an object of the present invention to provide a closure device which, when open, does not interfere with the use of the fireplace, the free movement of logs and other combustible materials, the use of common fireplace tools, the removal of ashes, or cleaning of the firebricks and grate and, when closed, prevents sparks and other burning materials from entering the room, shields the room from ashes, soot and cold drafts, seals the opening to prevent heat loss from the room and does so while presenting an attractive appearance.

A further object of the invention is to provide a closure device wherein it is unnecessary to open and close the fireplace damper and hence the danger of starting a fire with the damper closed is alleviated.

A further object of the invention is to provide a device which can be readily used with fireplaces of various sizes by incorporating adjustable clamps to secure the device in place.

Another object of the invention is to provide an apparatus that is simplistic in design, easily manufactured, reliable, safe and easily installed without the need of special tools and equipment.

These objects and other objects which will become apparent as the description proceeds are achieved by a fireplace safety closure device, comprising: a frame means partially extending over a wall having an opening therein defining the fireplace, a plurality of hingedly interconnected horizontal slats and, a storage box comprising the bottom horizontal member of the frame means for storing the horizontal slats.

BRIEF DESCRIPTION OF THE DRAWINGS

In the accompanying drawings which form a part of this specification.

DESCRIPTION OF THE PREFERRED EMBODIMENT

Figure 1:
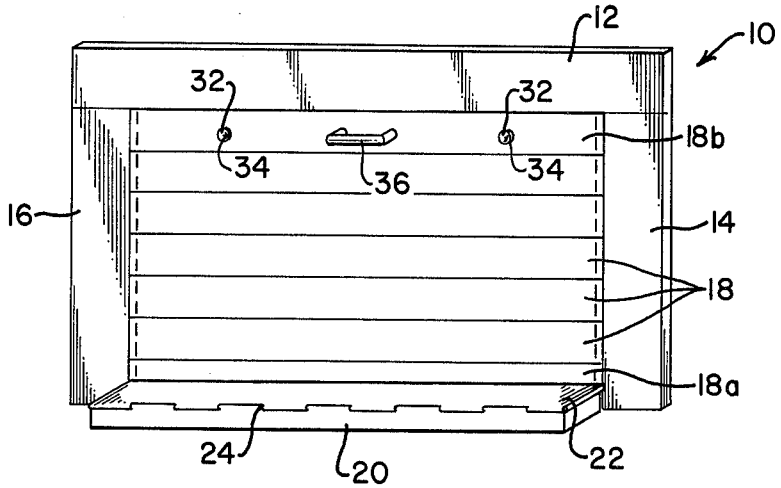
FIG. 1 is a front view of the complete fireplace closure device frame and storage box with the device in the closed position on the tapered pins.
Figure 2:
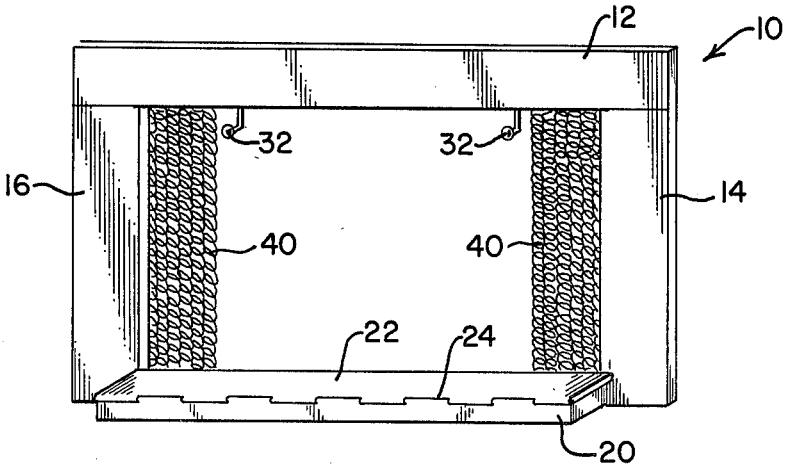
FIG. 2 is a front view with the device in the open position with the closure device in the storage box and the wire mesh screen in the partially open position.

Referring to the drawings in detail wherein the parts are indicated with numerals, the fireplace heat retaining and safety closure device, designated generally by the numeral 10, is illustrated in FIGS. 1 and 2 as including a frame having a horizontal member 12 and two vertical members 14, 16. Also provided as a part of the closure device is a plurality of horizontal hingedly connected slats 18 extending between the vertical frame members 14, 16 and being storable in a storage box 20 which forms the bottom horizontal member of the frame. The storage box 20 is provided with a cover 22 connected to the box at the front with a hinge 24. When in the closed position, the cover 22 forces the horizontal slats 18 into sealing engagement with the vertical frame members 14, 16.

Figure 3:
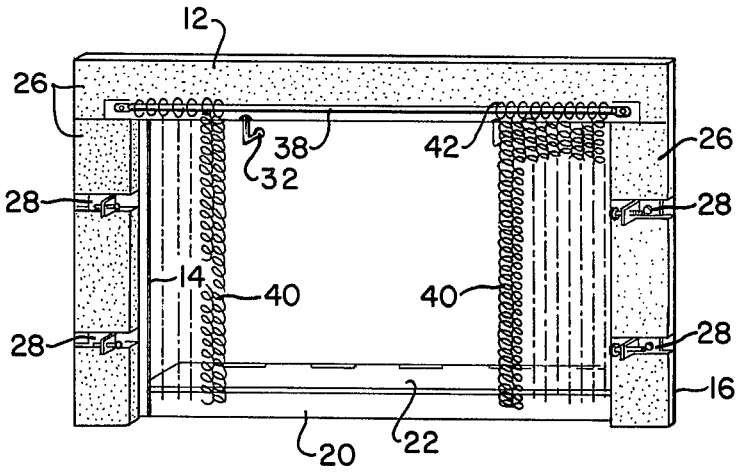
FIG. 3 is an inside view of the device, showing the adjustable clamps and the wire mesh screen.

The preferred embodiment of the frame assembly consists of vertical members 14, 16 and top horizontal member 12 manufactured of metal or rigid high temperature non-metal materials and secured to one another by bolts, clamps, weldments or the like. As best illustrated in FIG. 3, the frame assembly is also lined on the inside with insulation 26 and provided on the inside periphery with a number of rotatable, adjustable screw clamps 28 for holding the closure device 10 in securing engagement with fireplace openings of various sizes.

Figure 4:
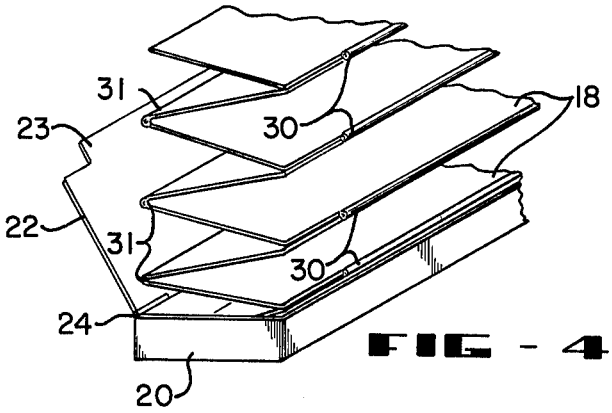
FIG. 4 is a view of the hinged rectangular slats in a partially folded position showing the manner in which the slats enter the storage box.
Figure 5:
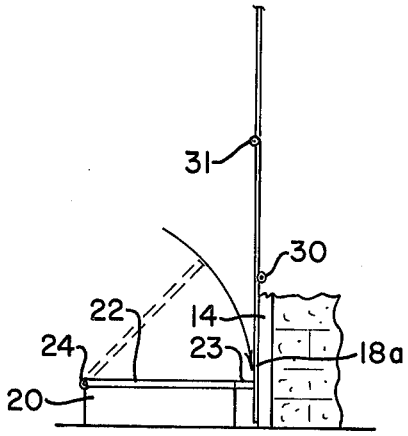
FIG. 5 is a side view of the storage box and the box cover showing the manner in which the cover seals the slats against the frame.
Figure 6:
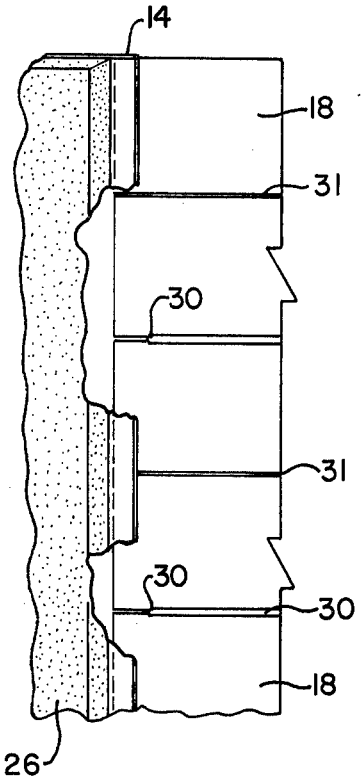
FIG. 6 is an inside view of the ends of the slats and the frame showing the cutoff of alternate hinges to permit a smooth airtight fit of the slats against the frame.
Figure 7:
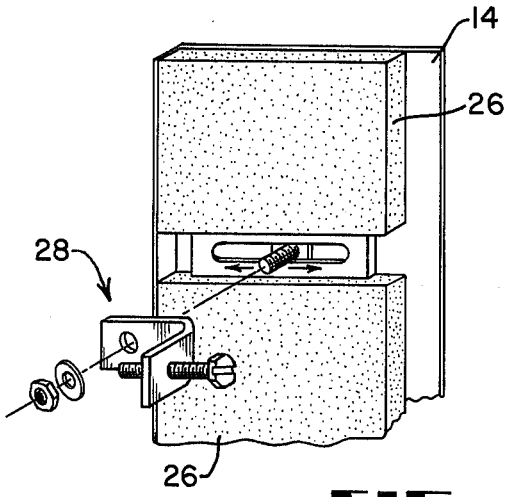
FIGS. 7 and 8 are inside view showings of two variations of the screw clamp positioning to fit fireplace openings of several sizes.
Figure 8:
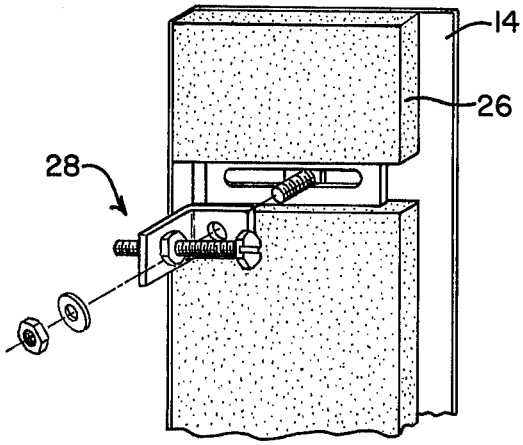

In FIG. 6, the horizontal slats 18 are shown as being of a length which permits them to overlap the edges of the vertical frame members 14, 16. Hinges 30, 31 are alternately positioned on the inside and the outside of the slats 18 respectively, permitting them to fold down accordian style for storage as illustrated in FIG. 4. Further, the inside hinges 30 are cut back from both ends of the slats 18, permitting a flush and tight fit against frame members 14, 16. Referring again to FIG. 1, it can be seen that the top horizontal frame member 12 includes tapered pins 32 extending perpendicularly therefrom. The top most horizontal slat **18*b* contains holes 34 and a type of handle 36 permitting the operator to lift the slats 18 and to place the holes 34 over the tapered pins 32, thereby securely closing the slats 18 against the top horizontal frame member 12. This preferred embodiment teaches a simple means of removing the slats 18 from the storage box 20 and placing them in securing engagement with the horizontal frame member 12 and vertical frame members 14, 16. As best shown in FIGS. 4 and 5, the box cover 22 is characterized by a protruding lip 23 which makes forceful sealing engagement with the slat 18***a* at the bottom while the tapered pins 32 hold the slats 18*b* firmly against the frame at the top. The intermediate slats 18 are held in secure engagement with the frame members 14, 16 by the interconnection provided by hinges 30, 31. When in the closed position, such engagement prevents warm room air from escaping from the room, prevents drafts of cold air from entering the room and prevents soot and odors from the fireplace from entering the room.

Extending across the full width of the frame opening is a rod 38 attached to the width of the top horizontal frame member 12. Rings 42 slidingly support the wire mesh screen 40 to the rod 38.

It should be recognized that the closure device 10 is simply and easily opened by raising the box cover 22 to the open position thereby releasing the sealing pressure on the bottom horizontal slat 18*a*. The top slat 18*b* is then lifted by the handle 38, thus removing the holes 34 from the tapered pins 32 to release the seal of the top slat 18*b*. The slats may then be folded accordian style down into the storage box 20, and the box cover 22 closed to prevent dirt from entering the box and prevent mechanical damage to the stored slats 18. With the slats 18 in the storage box 20, the operator may open and close the wire mesh screen 40 to permit access to the fireplace for starting the fire, adding combustible materials, removing ashes and for using the common fireplace tools.

In accordance with the patent statutes only the best mode and preferred embodiment of the invention has been presented and described in detail and to persons skilled in the art, various modifications and adaptations of the structure herein described will be readily apparent. However, it is to be understood that this invention is not to be limited to the exact arrangement of the parts shown in the drawings or described in this specification or the shape, size and materials of any of the parts. For an appreciation of the true breadth and scope of the invention, reference should therefore be had to the accompanying claims.

What is claimed is:

1. A fireplace heat retaining and safety closure device comprising a frame means designed to partially extend over a fireplace opening in flush contact with the opening, a storage box comprising the bottom horizontal member of the frame, said box having a top closure which is hinged to pivot toward the fireplace opening, a plurality of hinged, horizontal, metal slats of sufficient width and height to extend over the full opening of the frame means, and means to secure one end of the metal slats across the top of the frame means whereby a slat adjacent the storage box is pressed against the frame means by the top of the storage box when it is pivoted toward the fireplace opening to hold the metal slats in a flush relationship to the face of the frame means around the periphery thereof.

2. The fireplace closure device according to claim 1 wherein the means to secure one end of the metal slats across the top of the frame means are tapered pins which mate in receiving holes in the top metal slat so that a gravity action pulls the top metal slat down flush against the outer face of the frame means.

3. The fireplace closure device according to claim 2 wherein the metal slats are alternately hinged so that an accordion configuration is achieved, and the hinges on the sides of the metal slats adjacent to the frame means are cut away at each end of the slats, so that a flush relationship of the metal slats to the frame means is assured with the metal slats in closure position.

4. A fireplace closure device according to claim 3 which includes means for positioning and locking the frame means in sealing contact with the front surface of the fireplace opening.

5. The fireplace closure device as set forth in claim 4 which includes a metal mesh screen slidably connected to the frame for movement across the opening of the frame means.

* * * * *